US008485838B2

(12) United States Patent
Kataoka

(10) Patent No.: US 8,485,838 B2
(45) Date of Patent: Jul. 16, 2013

(54) LEVER-TYPE CONNECTOR WITH COLLECTIVE RUBBER STOPPER

(75) Inventor: Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 28 days.

(21) Appl. No.: 13/163,805

(22) Filed: Jun. 20, 2011

(65) Prior Publication Data

US 2012/0009809 A1 Jan. 12, 2012

(30) Foreign Application Priority Data

Jul. 9, 2010 (JP) ..... 2010-156726

(51) Int. Cl.
*H01R 13/52* (2006.01)

(52) U.S. Cl.
USPC ..... 439/271

(58) Field of Classification Search
USPC ..... 439/271, 157, 275
See application file for complete search history.

(56) References Cited

U.S. PATENT DOCUMENTS 2,669,702 A * 2/1954 Klostermann ..... 439/676
5,735,702 A * 4/1998 Hio ..... 439/157
6,142,826 A * 11/2000 Bourillon ..... 439/595
6,183,275 B1 * 2/2001 Okura et al. ..... 439/157
6,254,431 B1 * 7/2001 Murakami et al. ..... 439/587
6,464,522 B2 * 10/2002 Osawa et al. ..... 439/271
6,494,731 B1 * 12/2002 Suzuki ..... 439/275
6,517,368 B2 * 2/2003 Hara et al. ..... 439/271
6,527,586 B2 * 3/2003 Okamura et al. ..... 439/587
6,547,584 B2 * 4/2003 Myer et al. ..... 439/352
6,592,384 B2 * 7/2003 Sawayanagi ..... 439/157
6,752,659 B2 * 6/2004 Nakamura et al. ..... 439/587
6,994,590 B2 * 2/2006 Nishida ..... 439/587
7,448,908 B2 11/2008 Iwahori et al.
7,704,086 B2 * 4/2010 Gimbel et al. ..... 439/157

* cited by examiner

*Primary Examiner* — Briggitte R Hammond
*Assistant Examiner* — Vladimir Imas
(74) *Attorney, Agent, or Firm* — Gerald E. Hespos; Michael J. Porco; Matthew T. Hespos

(57) ABSTRACT

A first housing (10) has a frame (11) with concave accommodation portions (20). A sub-connector (31) with female terminal fittings (33) is accommodated in the concave accommodation portions (20). A collective rubber stopper (36) is accommodated inside the concave accommodation portions (20) to seal a gap between a peripheral surface of an electric wire (34) pulled out of the sub-connector (31) and an inner peripheral surface of each concave accommodation portion (20). A first cam follower (19) is formed on an outer surface of the frame (11) and can engage an operation member (80). The frame (11) has an outer wall (12) defining an outer surface thereof where the first cam follower (19) is formed and an inner wall (18) separated from the outer wall part (12) via separated spaces (17) and constructing the inner peripheral surface of each concave accommodation portions (20).

8 Claims, 8 Drawing Sheets

LEVER-TYPE CONNECTOR WITH COLLECTIVE RUBBER STOPPER

BACKGROUND OF THE INVENTION

1. Field of the Invention

The invention relates to a connector.

2. Description of the Related Art

U.S. Pat. No. 7,448,908 discloses a waterproof connector with first and second housings that are fit together by operating a lever. The first housing has a frame with concave accommodation parts and sub-connectors having terminal fittings are accommodated in the concave accommodation parts. A collective rubber stopper is accommodated in the concave accommodation parts to seal gaps between electric wires pulled out of the sub-connectors and inner peripheries of the concave accommodation parts. An engaging part is formed on the outer surface of the frame and defines a supporting shaft for pivotably supporting the lever. The lever has a cam groove that engages a cam follower of the second housing. Pivoting the lever generates a cam action between the cam groove and the cam follower that urges the first and second housings together.

Fit-on resistance between the first and second housings creates a reaction force that acts on the engaging part when a pivotal operation force is imparted to the lever. Thus, there is a fear that the outer wall of the frame will deform. Such a deformation will generate a gap between inner surfaces of the concave accommodation portions and the outer surface of the collective rubber stopper and could adversely affect the waterproof performance.

The invention has been completed based on the above-described situation. It is an object of the invention to prevent deterioration of the waterproof performance of a connector.

SUMMARY OF THE INVENTION

The invention relates to a connector with first and second housings that are fit together by operating an operation member. The first housing has a frame with concave accommodation portions and sub-connectors with terminal fittings are accommodated in the accommodation portions. A collective rubber stopper is accommodated in the concave accommodation portions to seal a gap between peripheral surfaces of electric wires pulled out of the sub-connectors and an inner peripheral surface of each concave accommodation portions. An engaging part is formed on an outer surface of the frame and can engage the operation member. The frame has an outer wall that defines an outer surface of the frame where the engaging part is formed. The frame also has an inner wall separated from the outer wall by separated spaces. The inner wall defines the inner peripheral surface of each of the concave accommodation portions.

The first housing preferably has a holder that is mounted on the sub-connector to hold the collective rubber stopper and the sub-connector together. A tubular protection part is formed on the holder and surrounds the collective rubber stopper. The tubular protection part is accommodated in the separated spaces when the holder is mounted on the frame.

The operation member preferably is supported pivotally on a rotating shaft that extends in a direction intersecting a direction in which the first and second housings are fit together. The outer wall and openings of the concave accommodation portions are approximately rectangular when viewed in the direction in which the first and second housings are fit together. The separated spaces are disposed essentially along sides intersecting the rotating shaft of the operation member.

The frame preferably has a plurality of independent tubular accommodation parts in which the concave accommodation portions are formed. A part of each tubular accommodation part functions as the inner wall separated from the outer wall.

The sub-connectors and the collective rubber stopper preferably are combined with each other to form a connector unit. Wrong coupling prevention parts are provided in proximity to the connector unit and an edge of an opening of each of the concave accommodation portions of the frame and fit together to allow the connector unit to be mounted on the accommodation concave portion only when the connector unit is a correct combination with the concave accommodation portion.

The separated space is between the outer wall that defines the outer surface of the frame where the first cam follower is formed and the inner wall that defines the inner peripheral surfaces of the concave accommodation portions. The outer wall may deform due to the operation of the lever. However, the deformation of the outer wall does not affect the inner wall. Therefore, the deformation of the outer wall will not deteriorate the performance of the sealing between the inner peripheral surface of each of the concave accommodation portions and the peripheral surface of the collective rubber stopper.

The peripheral surface of the collective rubber stopper is surrounded with the tubular protection part and thus protected from interference of foreign matter in the state before the sub-connector and the collective rubber stopper are mounted on the concave accommodation portions. This protection of the peripheral surface of the collective rubber stopper from damage prevents deterioration in the sealing performance of the connector. Further, the separated space is utilized effectively for accommodating the tubular protection part. Thus, the tubular protection part will not project significantly outside when the holder is mounted on the frame. Thus, the first housing need not be large.

Deformation of the outer wall caused by operation of the operation member greatly affects the sides disposed in the direction intersecting the rotating shaft of the operation member. However, the separated space is disposed along the sides intersecting the rotating shaft of the operation member. Thus, it is possible to avoid the influence of the deformation of the outer wall due to the operation of the operation member.

The tubular accommodation parts that define the adjacent concave accommodation concave portions are formed independently of each other. Thus even if any one of the tubular accommodation parts deforms, there is no fear that the deformation thereof affects the other tubular accommodation parts.

Wrong coupling prevention parts are formed on the connector unit and the frame to prevent an incorrect combination of a connector unit and a concave accommodation portion.

DETAILED DESCRIPTION OF THE PREFERRED EMBODIMENTS

Figure 5:
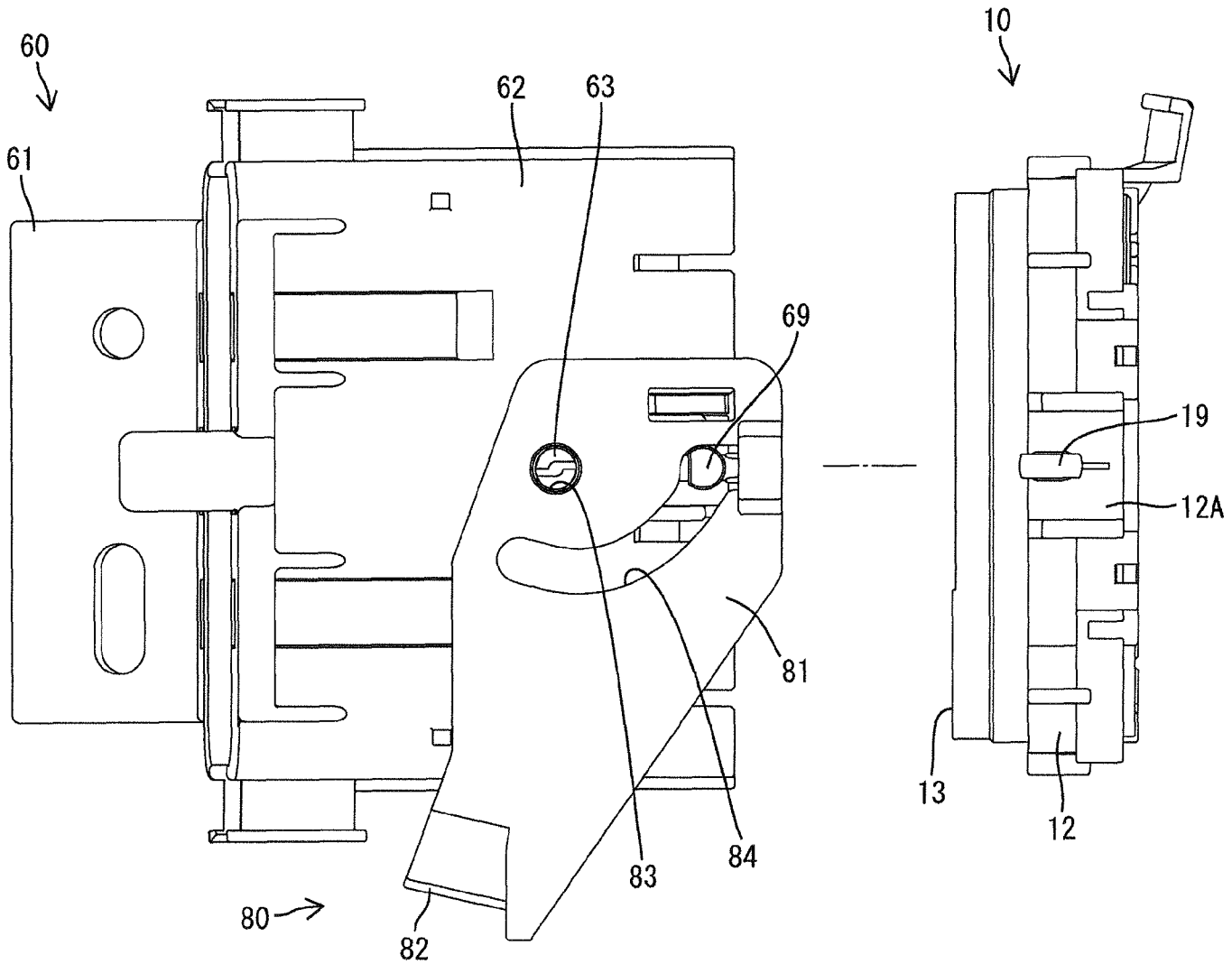
FIG. 5 is a front view before the first and second housings are fit together.

A connector in accordance with the invention has first and second housings 10 and 60 and a lever 80, as shown in FIG. 5.

The connector has a waterproof function and a means for preventing deterioration of the sealing performance when the lever 80 is pivoted.

Figure 1:
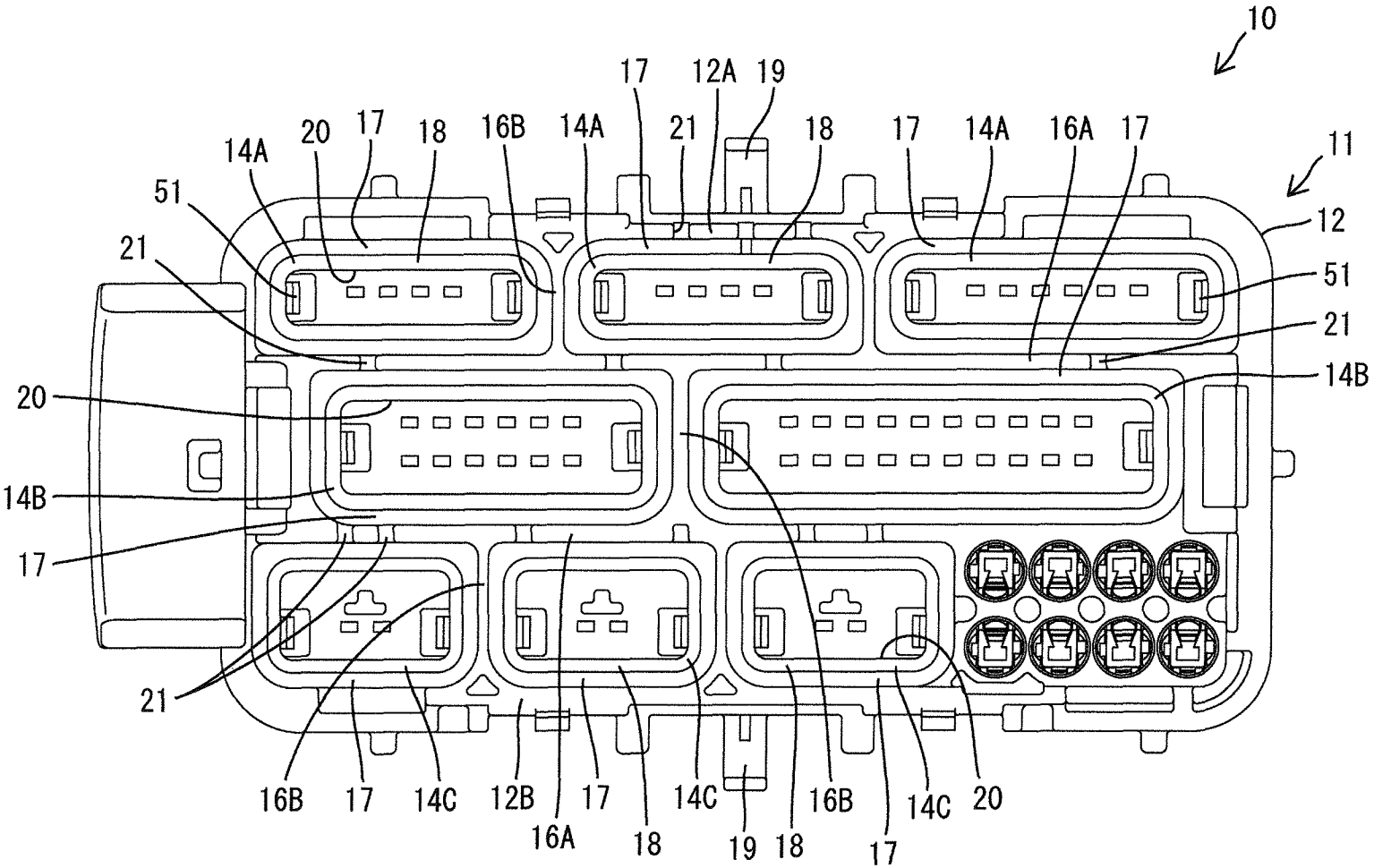
FIG. 1 is a rear view showing a state in which a connector unit is not mounted on a first housing in accordance with an embodiment of the invention.
Figure 2:
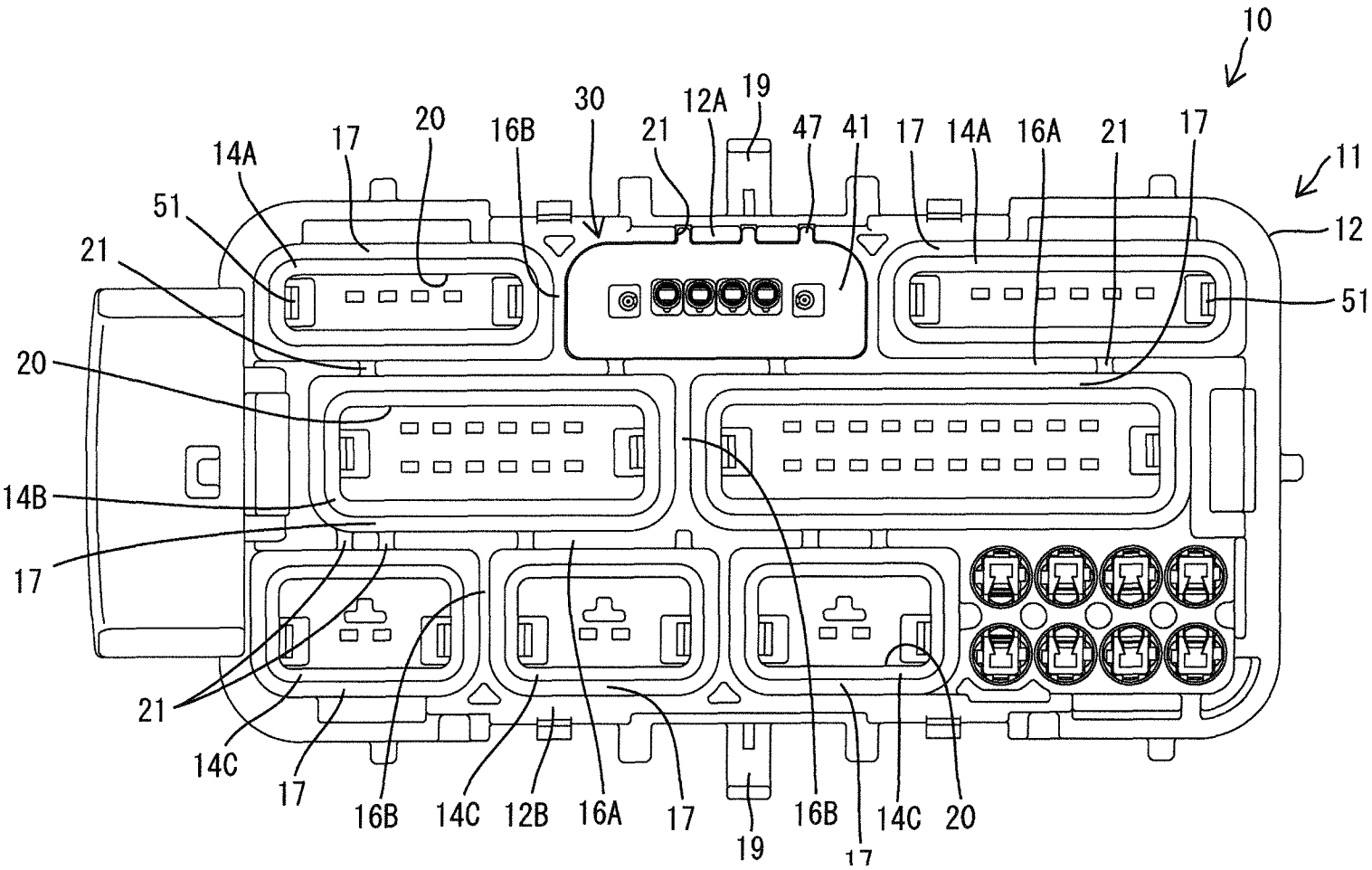
FIG. 2 is a rear view showing one connector unit mounted on the first housing.

The first housing 10 has a frame 11 made of synthetic resin and a plurality of connector units 30. The frame 11 is approximately rectangular when is seen from the front (the configuration projected onto a plane orthogonal to a direction in which the first and second housings 10 and 60 are fit together). The frame 11 has an approximately quadrangular prism-shaped outer wall 12 (see FIGS. 1 and 2) and a front wall (see FIGS. 3 and 4) 13 covering a front end of a space surrounded by the outer wall 12. As shown in FIGS. 1 and 2, a plurality of tubular accommodation parts 14A, 14B, and 14C are formed in the space surrounded by the outer wall 12 and extend rearward from the front wall 13. Each tubular accommodation part 14A, 14B, and 14C is wide and approximately rectangular in a rear view (the configuration projected onto the projection plane orthogonal to the direction in which the first and second housings 10 and 60 are fit together). The tubular accommodation parts 14A, 14B, and 14C are independent of each other and also independent of the outer wall 12.

The tubular accommodation parts 14A, 14B, and 14C are disposed to define an upper stage, a middle stage, and a lower stage. More specifically, the tubular accommodation parts 14A having the same heights are disposed side by side on the upper stage. The tubular accommodation parts 14B having the same heights are disposed side by side on the middle stage. The tubular accommodation parts 14C having the same heights are disposed side by side on the lower stage. The width dimensions of the tubular accommodation parts 14A, 14B, and 14C are different from one another. An inner space of each of the tubular accommodation parts 14A, 14B, and 14C is open at the rear of the frame 11 to form a concave accommodation portion 20 for accommodating a sub-connector 31 and a collective rubber stopper 36.

Figure 3:
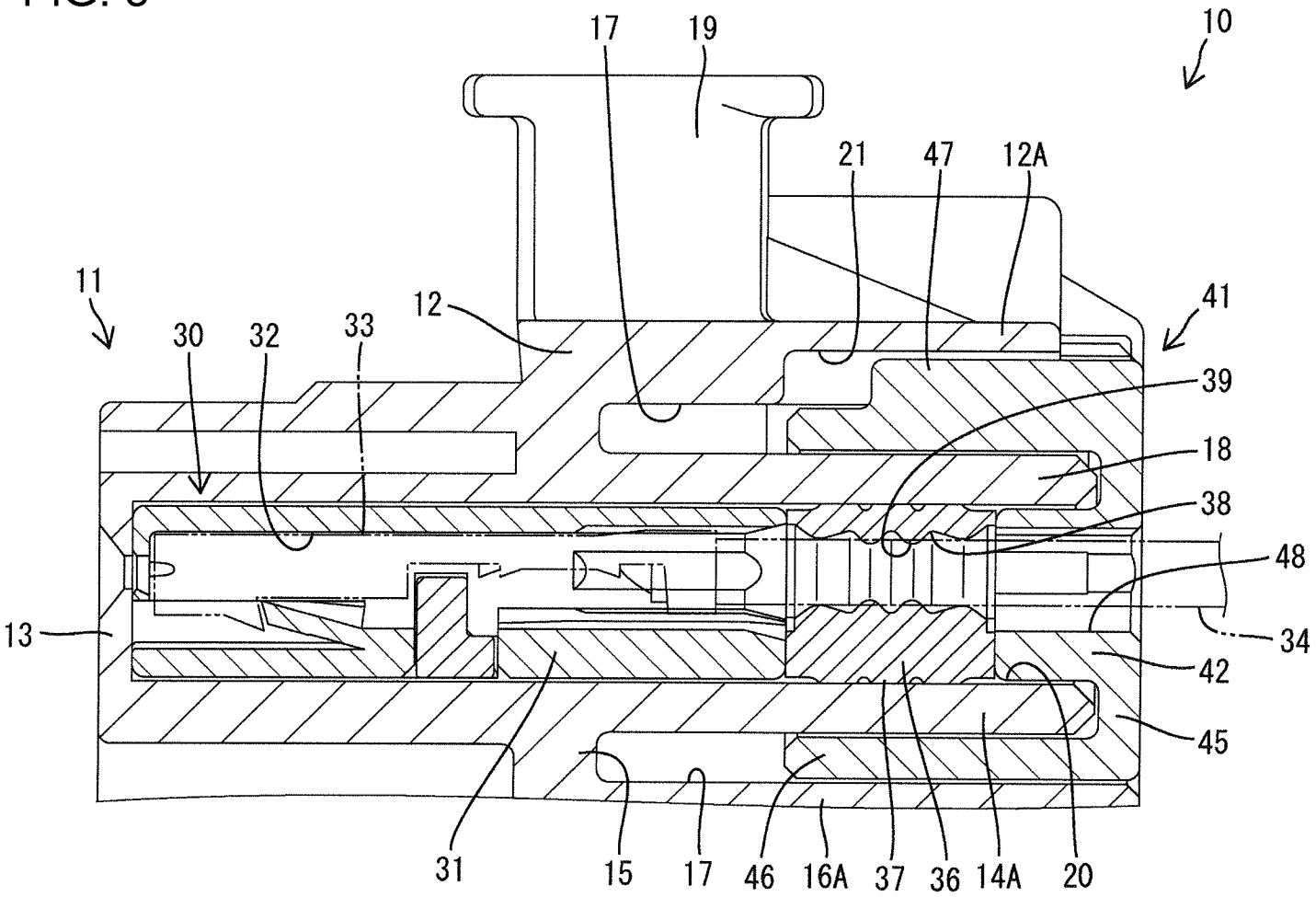
FIG. 3 is a vertical sectional view of the first housing.
Figure 4:
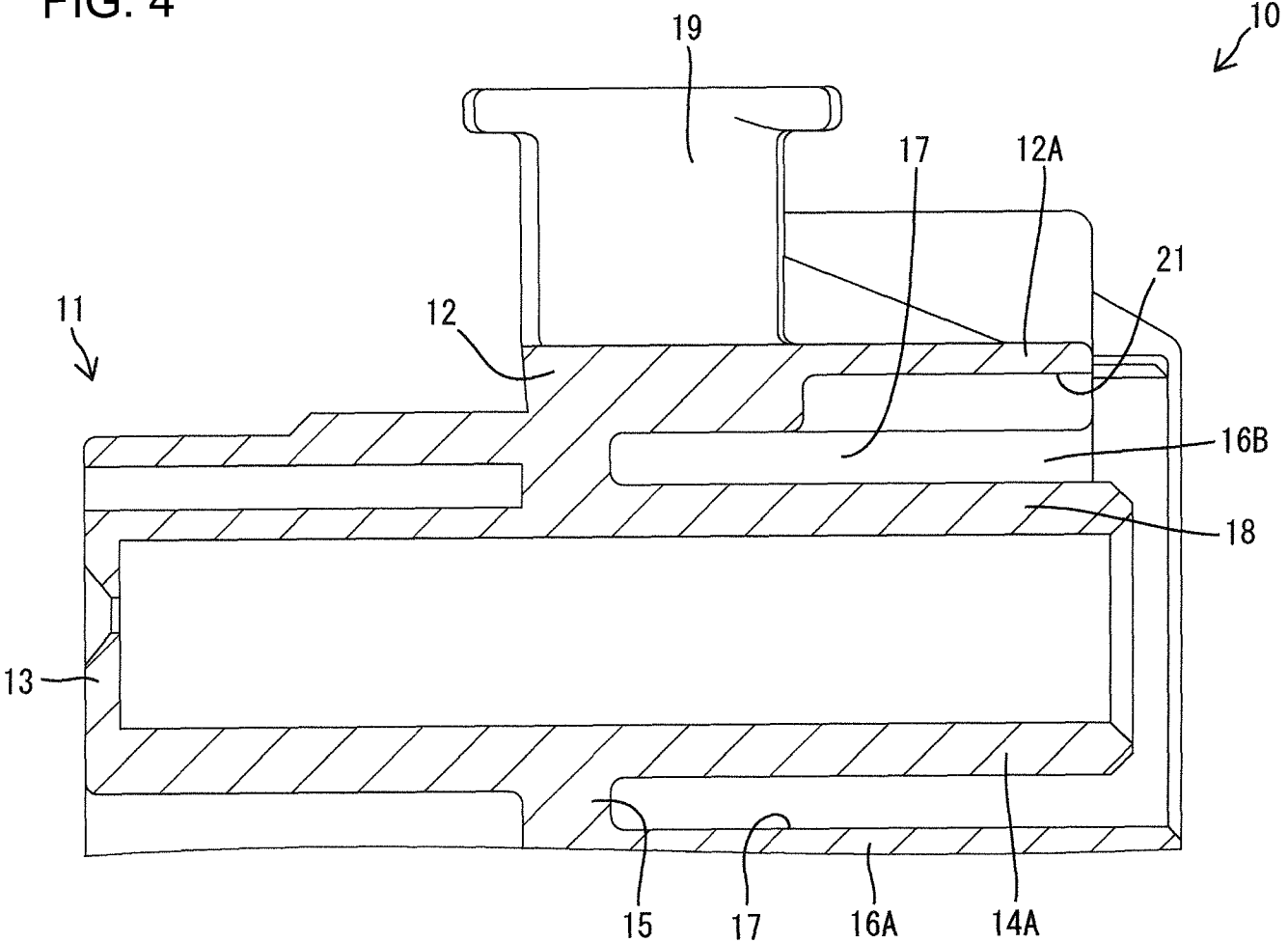
FIG. 4 is a vertical sectional view showing a state in which the connector unit is removed from a frame.

As shown in FIGS. 3 and 4, a connection wall 15 is formed in the space surrounded by the outer wall 12. The connection wall 15 connects peripheral surfaces of adjacent tubular accommodation parts 14A, 14B, and 14C to each other and connects an inner surface of the outer wall 12 to peripheral surfaces of the adjacent tubular accommodation parts 14A, 14B, and 14C. The connection wall 15 is disposed at an approximately central position of the frame 11 in a longitudinal direction (a direction parallel to the direction in which the first and second housings 10 and 60 are fit together). The connection wall 15 fills a gap between the tubular accommodation parts 14A and 14B, a gap between the tubular accommodation parts 14B and 14C, and a gap between the outer wall 12 and each of the tubular accommodation part 14A, 14B, and 14C.

As shown in FIGS. 1 and 2, horizontal ribs 16A are formed in spaces between the vertically adjacent tubular accommodation parts 14A and 14B and in spaces between the vertically adjacent tubular accommodation parts 14B and 14C. Similarly, vertical ribs 16B are formed in the spaces between the horizontally adjacent tubular accommodation parts 14A, in the spaces between the horizontally adjacent tubular accommodation parts 14B, and in the spaces between the horizontally adjacent tubular accommodation parts 14C. The ribs 16A and 16B extend longitudinally rearward from the connection wall 15 and are parallel with walls of the tubular accommodation parts 14A, 14B, and 14C when they are projected onto the projection plane orthogonal to the direction in which the first and second housings 10 and 60 are fit together. The horizontal ribs 16A are continuous in the entire region where the vertically adjacent tubular accommodation parts 14A and 14B confront each other and where the vertically adjacent tubular accommodation parts 14B and 14C confront each other. Thus, the horizontal ribs 16A partition the vertically adjacent tubular accommodation parts 14A and 14B from each other and partition the vertically adjacent tubular accommodation parts 14B and 14C from each other. The vertical ribs 16B are continuous in the entire region where the horizontally adjacent tubular accommodation parts 14A confront each other, where the horizontally adjacent tubular accommodation parts 14B confront each other, and where the horizontally adjacent tubular accommodation parts 14C confront each other. Thus, the vertical ribs 16B partition the horizontally adjacent tubular accommodation parts 14A from each other, partition the horizontally adjacent tubular accommodation parts 14B from each other, and partition the horizontally adjacent tubular accommodation parts 14C from each other. The horizontal and vertical ribs 16A and 16B are partly continuous with the inner surface of the outer wall 12.

The upper horizontal rib 16A extends in the left-to-right direction and partitions the tubular accommodation part 14A at the upper stage from the tubular accommodation part 14B at the middle stage. Both ends of the upper horizontal rib 16A are continuous with the outer wall 12. The lower horizontal rib 16A extends in the left-to-right direction and partitions the tubular accommodation part 14B at the middle stage from the tubular accommodation part 14C at the lower stage. Both ends of the lower horizontal rib 16A are continuous with the outer wall 12. The vertical rib 16B that partitions adjacent upper-stage tubular accommodation parts 14A has an upper end continuous with an upper panel 12A of the outer wall 12 and a lower end continuous with the upper-stage horizontal rib 16A. The vertical rib 16B that partitions adjacent middle-stage tubular accommodation parts 14B has an upper end continuous with the upper horizontal rib 16A and a lower end continuous with the lower-stage horizontal rib 16A. The vertical rib 16B that partitions adjacent lower-stage tubular accommodation parts 14C has an upper end continuous with the lower horizontal rib 16A and a lower end continuous with a lower panel 12B of the outer wall 12.

Approximately quadrangular prism-shaped separated spaces 17 are defined between the outer wall 12 and the peripheries of the tubular accommodation parts 14A, 14B, and 14C. The separated spaces 17 surround the entire peripheries of the tubular accommodation parts 14A, 14B, and 14C and are isolated from each other via the horizontal ribs 16A and the vertical ribs 16B. A first part of each separated space 17 separates the tubular accommodation parts 14A, 14B, and 14C from the horizontal rib 16A and the vertical rib 16B, whereas a second part of each separated space 17 separates the outer wall 12 from the tubular accommodation parts 14A, 14B, and 14C. The tubular accommodation parts 14A, 14B, and 14C have inner walls 18 opposed to and approximately parallel to the outer wall 12 and separated from the outer wall 12 by the separated space 17.

Deformation of the walls of the tubular accommodation parts 14A, 14B, and 14C separated from one another through the horizontal rib 16A, the vertical rib 16B, and two separated spaces 17 does not affect one another. Deformation of the wall 18 of the tubular accommodation parts 14A, 14B, and 14C and that of the outer wall 12 separated from each other through the separated space 17 do not affect each other either. Thus, the separated space 17 functions as deformation transmission prevention means for preventing the transmission of the deformation among the walls.

Upper and lower first cam followers 19 project out from upper and lower panels 12A and 12B respectively of the outer wall 12. The first cam followers 19 are disposed at approximately the center of the frame 11 in the longitudinal direction. The first cam followers 19 engage the lever 80 as described later to display a double force action while fitting the first and second housings 10 and 60 together and separating them from each other. The first cam followers 19 are a little rearward from the connection wall 15.

Concave fit-on portions are formed on the frame 11 by cutting out a rear edge of the outer wall 12 and a rear edge of the horizontal rib 16A. Each concave fit-on portion 21 is disposed near an edge of an opening of each of the concave accommodation portions 20 and forms a groove extended longitudinally and parallel with the direction in which the first and second housings 10 and 60 are fit together. The concave fit-on portion 21 functions as a wrong coupling prevention means for preventing the connector unit 30, described later, from being mounted on the concave accommodation portion 20 in a wrong combination.

Figure 7:
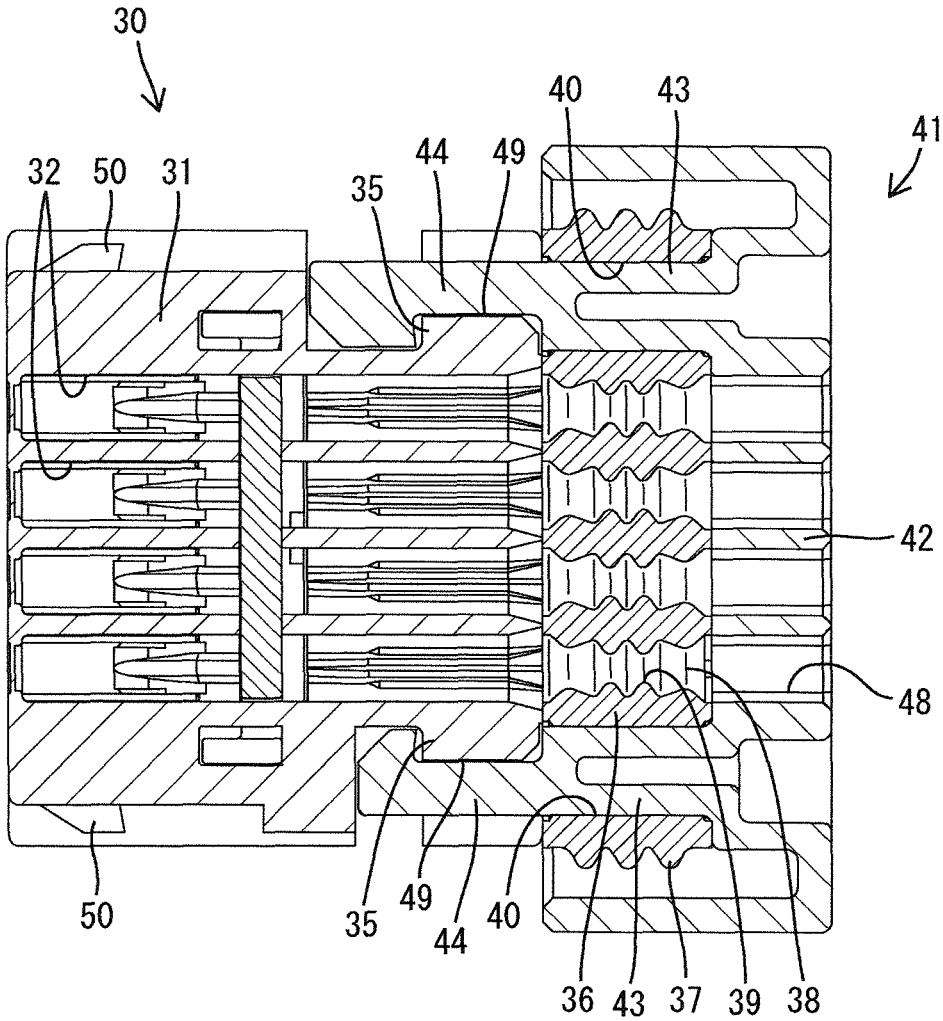
FIG. 7 is a horizontal sectional view of the connector unit.
Figure 8:
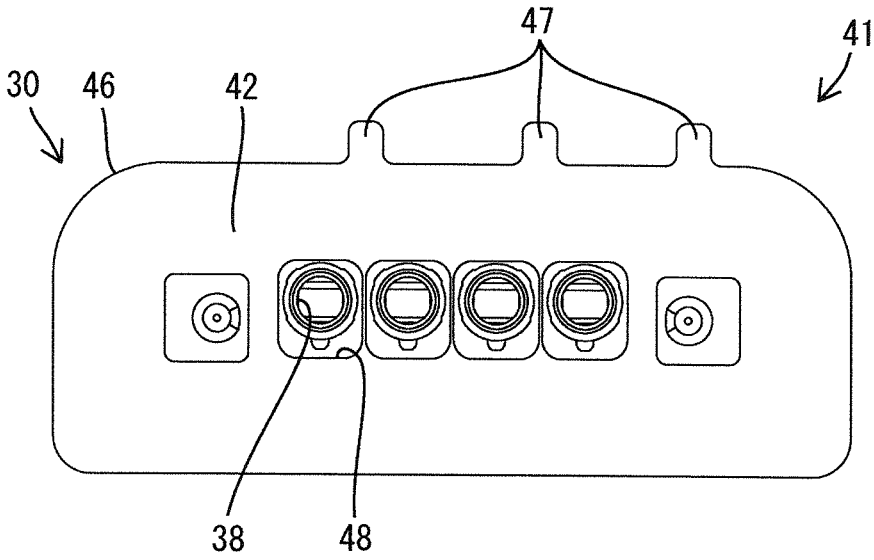
FIG. 8 is a rear view of the connector unit.

As shown in FIGS. 3 and 7, each connector unit 30 is constructed of the sub-connector 31 made of synthetic resin, the collective rubber stopper 36, and a holder 41 made of synthetic resin. Female terminal fittings 33 are inserted into the connector units 30 respectively. The sub-connector 31 is a wide block corresponding to the configuration of the opening of the concave accommodation portion 20. Cavities 32 are formed in the sub-connector 31 and are arranged widthwise. The female terminal fittings 33 are inserted into the cavities 32 from the rear. An electric wire 34 connected to the rear end of the female terminal fitting 33 is pulled out to the rear of the sub-connector 31. Stepped locking parts 35 are formed at left and right edges of the sub-connector 31.

The collective rubber stopper 36 has a wide approximately rectangular shape corresponding to the configuration of the opening of the concave accommodation portion 20. Outer peripheral lips 37 are formed on the periphery of the collective rubber stopper 36 and insertion holes 38 penetrate longitudinally through the collective rubber stopper 36 at positions corresponding to the respective cavities 32. Inner peripheral lips 39 are formed on an inner periphery of each insertion hole 38. Left and right positioning holes 40 penetrate longitudinally through left and right ends of the collective rubber stopper 36 so that the positioning holes 40 sandwich the region where the insertion holes 38 are formed.

The holder 41 has a wide body 42 corresponding to the concave accommodation portion 20. Positioning parts 43 project forward from left and right ends of the body 42 and a locking arm 44 is cantilevered forward from the projected end surface of each positioning part 33. Guide holes 48 corresponding to the insertion holes 38 of the collective rubber stopper 36 penetrate longitudinally through the body 42. A flange 45 protrudes out over the entire periphery of the body 42 from the peripheral edge of the body 42 and a tubular protection part 46 is cantilevered forward over the entire periphery of the flange 45.

A convex fit-on portion 47 projects from the peripheral surface of the tubular protection part 46. The convex fit-on portion 47 is a rib that extends longitudinally and parallel with the direction in which the first and second housing 10 and housings 60 are fit together. The convex fit-on portion 47 is fit in the concave fit-on portion 21 only when the connector unit 30 that is a correct combination with the concave accommodation portion 20 is mounted thereon. That is, the convex fit-on portion 47 and the concave fit-on portion 21 function as a wrong coupling prevention means for preventing the wrong connector unit 30 from being mounted on the concave accommodation portion 20.

The component parts of the connector unit 30, namely, the sub-connector 31, the collective rubber stopper 36, and the holder 41 are combined before the connector unit 30 is mounted on the frame 11. Thus, the positioning part 43 of the holder 41 penetrates through the positioning hole 40 of the collective rubber stopper 36, and a rear surface of the collective rubber stopper 36 is brought into contact with a front surface of the body part 42 of the holder 41 to combine the collective rubber stopper 36 and the holder 41. Thereafter the combined rubber stopper 36 and holder 41 are mounted on the sub-connector 31 from the rear so that the locking arms 44 slide along the guide grooves 49 formed on the left and right side surfaces of the sub-connector 31.

The locking arm 44 is locked to the locking part 35 when the collective rubber stopper 36 contacts the rear surface of the sub-connector 31 so that the collective rubber stopper 36 and the holder 41 cannot separate rearward from the sub-connector 31. Additionally, the engagement of the locking arm 44 in the guide groove 49 prevents the collective rubber stopper 36 and the holder 41 from separating vertically from the sub-connector 31. In this manner, the sub-connector 31, the collective rubber stopper 36, and the holder 41 are combined to form the connector unit 30 is constructed.

The tubular protection part 46 surrounds the entire periphery of the collective rubber stopper 36 on the assembled connector unit 30 so that foreign matter cannot interfere with the outer peripheral lips 37 of the collective rubber stopper 36. Thus, the outer peripheral lips 37 cannot be damaged and deformed.

The female terminal fittings 33 are inserted into the assembled connector units 30 respectively from the rear. More particularly, the female terminal fittings 33 are passed sequentially through the guide holes 48 of the holder 41 and the insertion holes 38 of the collective rubber stopper 36 and are accommodated in the respective cavities 32. The electric wires 34 penetrate through the insertion holes 38 when the female terminal fittings 33 are accommodated in the respective cavities 32, and the inner peripheral lips 39 adhere liquid-tightly to the peripheral surface of the electric wire 34.

The connector unit 30 with the inserted female terminal fittings 33 is mounted on the concave accommodation portion 20 from the rear of the frame 11. More particularly, the sub-connector 31 and the collective rubber stopper 36 are inserted into the concave accommodation portion 20, and a front of the body part 42 of the holder 41 also is inserted into the concave accommodation portion 20. The front end of the sub-connector 31 of the correctly mounted connector unit 30 substantially contacts the front wall 13 of the frame 11, and locking projections 50 (see FIG. 7) at front ends of left and right side edges of the sub-connector 31 are locked to locking arms 51 (see FIGS. 1 and 2) of the frame 11. Thus, the connector unit 30 is held and prevented from being displaced longitudinally relative to the concave accommodation portion 20 (frame 11).

The outer peripheral lips 37 of the collective rubber stopper 36 closely and liquid-tightly contact the inner peripheral surface of the concave accommodation portion 20 when the connector unit 30 has been mounted correctly on the concave accommodation portion 20. Thus, the gap between the inner surface of the concave accommodation portion 20 and the periphery of the electric wire 34 that penetrates through the concave accommodation portion 20 has a liquid-tight state so that water cannot penetrate into the concave accommodation portion 20 from the rear. Further the flange 45 of the holder 41 contacts or approaches the rear end of the tubular accommodation parts 14A, 14B, and 14C and the tubular protection part 46 of the holder 41 is fit in the separated space 17.

The convex fit-on portion 47 of the connector unit 30 fits on the concave fit-on portion 21 of the frame 11 when mounting the correct connector unit 30 on the accommodation concave portion 20. Thus, the connector unit 30 is mounted without trouble. On the other hand, the convex fit-on portion 47 interferes with a position of the rear edge of the frame 11 spaced from the concave fit-on portion 21 if the wrong connector unit 30 is attempted to be mounted to the concave accommodation portion 20 so the mounting operation cannot continue. Thus, the wrong connector unit 30 cannot be mounted on the concave accommodation portion 20.

Figure 6:
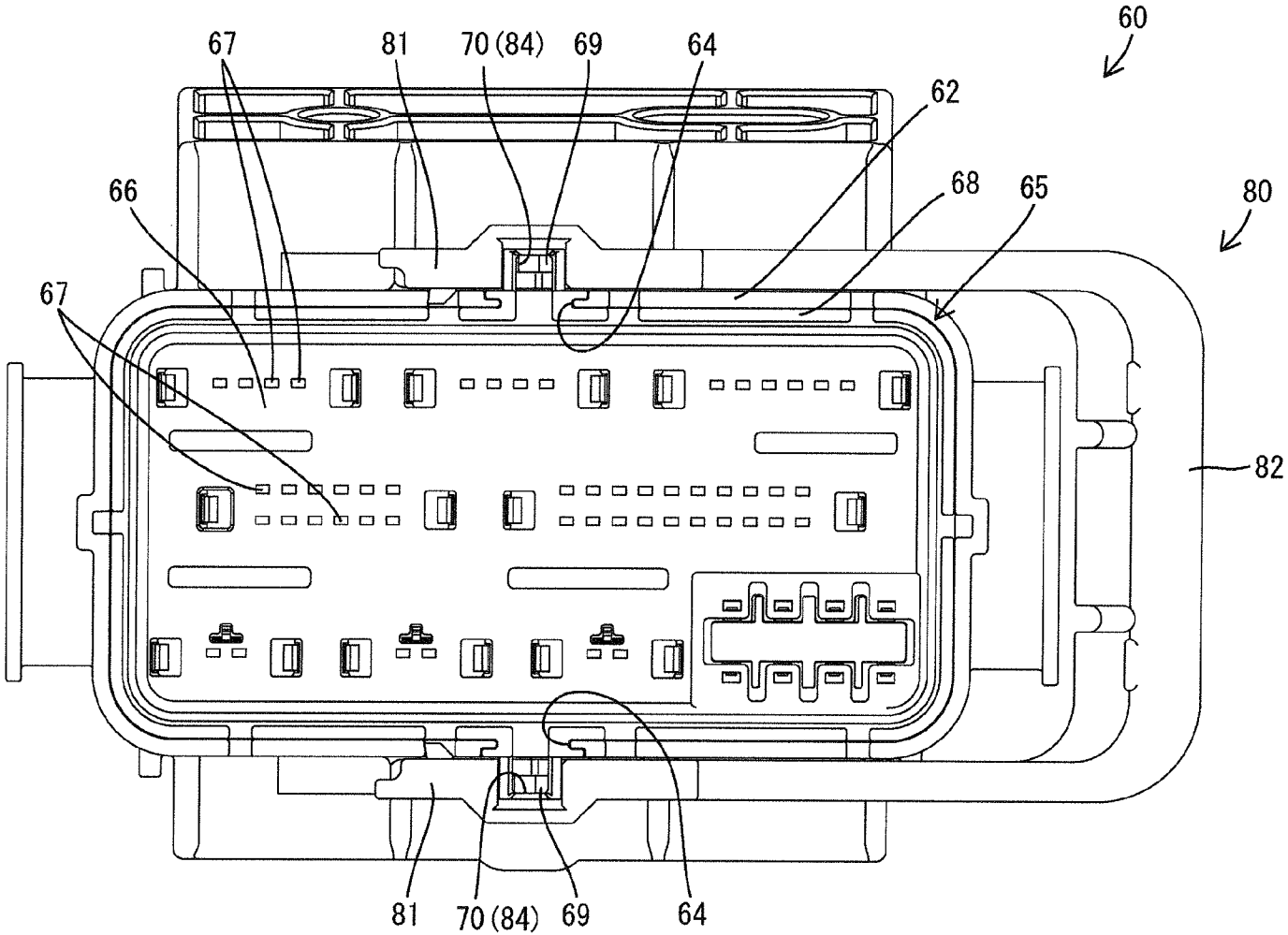
FIG. 6 is a front view of the second housing.

As shown in FIGS. 5 and 6, the second housing 60 is made of synthetic resin and has a terminal fitting-holding part 61. An approximately quadrangular prism-shaped hood 62 is integral with the terminal fitting-holding part 61 and is cantilevered forward from the terminal fitting-holding part 61. The terminal fitting-holding part 61 holds a plurality of male terminal fittings (not shown). A tab of each male terminal fitting disposed at the front end thereof projects forward beyond the terminal fitting-holding part 61 and is surrounded and protected by the hood 62. Rotating shafts 63 project from upper and lower surfaces of the hood 62 at approximately central position of the hood 62 in the left-to-right direction and at a position rearward from the front end of the hood 62 in the longitudinal direction. Escape grooves 64 are formed on upper and lower walls of the hood 62 by cutting out the hood 62 from the front edge to a position a little forward from the rotating shaft 63.

As shown in FIG. 6, a moving plate 65, having a known form, for guiding the tabs of the male terminal fittings is accommodated inside the hood 62. The moving plate 65 has a body 66 with through-holes 67 through which the tabs penetrate. A guide wall 68 is integral with the body 66 and extends forward from the periphery of the body 66. The moving plate 65 can be moved longitudinally without inclining the posture by sliding the guide wall 68 along the inner peripheral surface of the hood 62.

Second cam followers 69 project from upper and lower surfaces of the guide wall 68 at approximately central positions of the hood 62 in the left-to-right direction. Concave couplings 70 are formed on the second cam followers 69 and communicate with a space surrounded by the guide wall 68. The concave couplings 70 open at a position forward from the moving plate 65. The second cam followers 69 move longitudinally inside the escape groove 64 as the moving plate 65 moves inside the hood 62.

A lever 80 is mounted pivotably on the second housing 60. The lever 80 includes two arms 81 in the form of upper and lower plates and an operation part 82 integrally connects the arms 81 to each other. A bearing hole 83 is formed on each arm 81 and the rotating shaft 63 can fit in the bearing hole 83 so that the lever 80 can be pivoted on the rotating shaft 63 between an initial position (see FIG. 5) and a fit-on position. The pivot axis of the lever 80 defined by the rotating shaft 63 is perpendicular to the direction in which the first and second housings 10 and 60 are fit together and separated from each other. A cam groove 84 having a known form is formed on each arm 81 and the second cam follower 60 engages the cam groove 84.

To fit the first and second housings 10 and 60 together, the first housing 10 is inserted shallowly into the hood 62 of the second housing 60 with the lever 80 held at the initial position and the first cam follower 19 is fit in the concave coupling 70 of the second cam follower 69 of the moving plate 65, which waits at the entrance of the cam groove 84 to combine the first and second cam followers 19 and 69 with each other. Thereafter the lever 80 is pivoted toward the fit-on position. As a result, the double force action caused by the engagement between the cam groove 84 and the first and second cam followers 19 and 69 draws the first and second housings 10 and 60 together.

A pivotal operation force is imparted to the lever 80 while fitting the first and second housings 10 and 60 together and a reaction force caused by a fit-on resistance (contact resistance between the female terminal fitting 33 and the tab of the male terminal fitting) between the first and second housings 10 and 60 acts on the first and second cam followers 19 and 69. As a result, the outer wall 12 of the frame 11 rearward from the connection wall 15 may deform and displace out about the connection wall 15 so that a region of the outer wall 12 changes its posture obliquely. That is, the upper panel 12A of the outer wall 12 displaces up and the lower panel 12B of the outer wall 12 displaces down.

The upper and lower panels 12A and 12B of the outer wall 12 are coupled to each other through the vertical ribs 16B and the horizontal ribs 16A. Therefore the upper and lower panels 12A and 12B are difficult to deform outward. Further the separated space 17 is between the outer wall 12 and each of the tubular accommodation part 14A, 14B, and 14C. Thus the displacement region of the outer wall 12 is not connected directly to any of the tubular accommodation parts 14A, 14B, and 14C. Therefore even if the outer wall 12 deforms, the deformation is not transmitted to the tubular accommodation parts 14A, 14B, and 14C and the tubular accommodation parts 14A, 14B, and 14C will not deform.

The first and second housings 10 and 60 are fit together by operating the lever 80. The first housing 10 has the frame 11 with the concave accommodation portions 20. The sub-connector 31 has the female terminal fittings 33 and is accommodated in the concave accommodation portions 20. The collective rubber stopper 36 is accommodated in the concave accommodation portions 20 to seal the gap between the peripheral surface of the electric wire 34 pulled out of the sub-connector 31 and the inner peripheral surface of each of the concave accommodation portions 20. The first cam follower 19 is formed on the outer surface of the frame 11 and can engage the lever 80. The frame 11 has the outer wall 12 constructing the outer surface where the first cam follower 19 is formed and the inner wall 18 separated from the outer wall 12 via the separated spaces 17 and constructing the inner peripheral surface of each of the concave accommodation portions 20.

As described above, the separated space 17 is between the outer wall 12 defining the outer surface of the frame 11 where the first cam follower 19 is formed and the inner wall 18 defining the inner peripheral surface of each of the concave accommodation portions 20. Thus, even if the outer wall 12 deforms due to the operation of the lever 80, the deformation of the outer wall 12 does not affect the inner wall 18. Therefore, deformation of the outer wall 12 will not deteriorate the sealing between the inner peripheral surface of each of the concave accommodation portions 20 and the peripheral surface of the collective rubber stopper 36.

Deformation of the outer wall 12 due to operation of the lever 80 is large for the upper panel 12A and lower panel 12B disposed in the horizontal direction intersecting the rotating shaft 63 of the lever 80. In view of this point, the outer wall 12 and the opening of the concave accommodation portion 20 are approximately rectangular when are projected onto the projection plane orthogonal to the direction in which the first and second housings 10 and 60 are fit together. In addition, the separated space 17 is disposed along the horizontal sides that intersect the rotating shaft 63 of the lever 80. Thus, it is possible to avoid influence of the deformation of the outer wall 12 caused by operation of the lever 80.

The frame 11 has the tubular accommodation parts 14A, 14B, and 14C having the adjacent concave accommodation portions 20 respectively formed therein. The concave accommodation portions 20 are formed independently of each other. A part of each of the tubular accommodation parts 14A, 14B, and 14C functions as the inner wall 18 separated from the outer wall 12. The tubular accommodation parts 14A, 14B, and 14C of the concave accommodation portion 20 respectively are formed independently of each other. Thus even though any one of the tubular accommodation parts 14A, 14B, and 14C deforms, there is no fear that such deformation affects the other tubular accommodation parts 14A, 14B, and 14C.

In the state before the sub-connector 31 and the collective rubber stopper 36 are mounted on the concave accommodation portions 20, the peripheral surface of the collective rubber stopper 36 is surrounded with the tubular protection part 46 and thus protected from interference of foreign matter. Because the peripheral surface of the collective rubber stopper 36 will not be damaged, deterioration in the sealing performance thereof is prevented. Further because the separated space 17 is utilized as the space for accommodating the tubular protection part 46, there is no fear that the tubular protection part 46 projects outside in a large amount when the holder 41 is mounted on the frame 11. Thus the first housing 10 need not be large.

The invention is not limited to the embodiments described above with reference to the drawings. For example, the following embodiments are also included in the technical scope of the present invention.

All of the concave accommodation portions have the inner wall separated from the outer wall over the entire periphery thereof in the above-described embodiment. However, a part of the concave accommodation portions may be constructed so that a part of the circumference thereof is formed as the inner wall separated from the outer wall and other parts of the circumference are combined with the outer wall.

A part of each of the tubular accommodation parts defining the independent concave accommodation portions functions as the inner wall separated from the outer wall in the above-described embodiment. However, adjacent concave accommodation portions may be constructed so that a part of one tubular accommodation part and a part of the adjacent tubular accommodation part are continuous with each other or shared by both tubular accommodation parts.

Ribs continuous with the outer wall are formed between the inner walls of the adjacent concave accommodation portions in the above-described embodiment. However, instead the adjacent inner walls may directly confront each other without forming the ribs.

The lever (operation member) is mounted on the second housing, and the engaging part is the cam follower in the illustrated embodiment. However, the invention is applicable to a case where the lever (operation member) is mounted on the first housing, and the engaging part is a supporting shaft pivotably supporting the lever.

The operation member is a lever that pivots on the rotating shaft intersecting the direction in which the first and second housings fit together in the above-described embodiment. However, the operation member may be a slider that slides in a direction intersecting the direction in which the first and second housings are fit together.

When the sub-connector and the collective rubber stopper are taken out of the accommodation concave portion, the sub-connector and the collective rubber stopper are held by the holder in a combined state to form the connector unit in the above-described embodiment. However, the sub-connector and the collective rubber stopper may be separated from each other when taken out of the concave accommodation portion. In this case, the holder may be separated from the sub-connector and the collective rubber stopper or may be separated from the sub-connector and mounted on the collective rubber stopper.

The tubular protection part is formed on the holder and surrounds the collective rubber stopper in the above-described embodiment. However, the holder may have no tubular protection part.

The wrong coupling prevention part disposed at the frame is formed on the rib or the outer wall in the above-described embodiment. However, the wrong coupling prevention part may be formed on the tubular accommodation part.

What is claimed is:

1. A connector in which a first housing and a second housing are fit together by operating an operation member, the first housing comprising a frame formed with an outer wall having an outer surface, an engaging part formed on the outer surface for engaging the operation member, the frame further having an inner wall separated from the outer wall via separated spaces, the inner walls having inner peripheral surfaces defining concave accommodation portions;

at least one sub-connector accommodated in at least one of the concave accommodation portions and having a plurality of terminal fittings therein, wires connected respectively to the terminal fittings and pulled out of the respective sub-connector through the concave accommodation portion; and collective rubber stoppers accommodated in the concave accommodation portions and sealing gaps between peripheral surfaces of the electric wires pulled out of said sub-connectors and the inner peripheral surfaces of the concave accommodation portions; and holders mounted on the frame and holding the collective rubber stoppers in the concave accommodation portions.

2. The connector of claim 1, wherein each of the holder has a tubular protection part surrounding at least part of the respective concave accommodation portion and being accommodated inside the separated spaces when the holder is mounted on the frame.

3. The connector of claim 1, wherein said operation member is supported pivotally on a rotating shaft disposed in a direction intersecting a direction in which said first and second housings are fit together;

configurations of the outer wall and openings of each of said concave accommodation portions being approximately rectangular when viewed in a direction in which the first and second housings are fit together; and the separated spaces being disposed along sides intersecting with the rotating shaft of the operation member.

4. The connector of claim 1, wherein the frame has a plurality of tubular accommodation parts in which said concave accommodation portions are formed independently of each other; and a part of each of said tubular accommodation parts defining the inner wall separated from the outer wall.

5. A connector in which a first housing and a second housing are fit together by operating an operation member, the first housing comprising a frame formed with concave accommodation portions, at least one sub-connector accommodated in at least one of the concave accommodation portions and having a plurality of terminal fittings therein, a collective rubber stopper accommodated in the concave accommodation portions and sealing a gap between a peripheral surface of an electric wire pulled out of said sub-connector and an inner peripheral surface of each of the concave accommodation portions, and an engaging part formed on an outer surface of the frame and engaging said operation member; and the frame having an outer wall defining said outer surface thereof where said engaging part is formed; and an inner wall separated from the outer wall via separated spaces and constructing said inner peripheral surface of each of the concave accommodation portions, wherein the sub-connector and said collective rubber stopper are combined with each other to construct a connector unit; and wrong coupling prevention parts provided in proximity to the connector unit and an edge of an opening of each of said concave accommodation portions of said frame and being fit together only when the connector unit defining a correct combination with the concave accommodation portion is mounted thereon to allow said connector unit to be mounted on said concave accommodation portion.

6. The connector of claim 5, wherein said first housing has a holder mounted on the frame to hold the collective rubber stopper and said sub-connector in a combined state;

a tubular protection part formed on the holder and surrounding the collective rubber stopper; and said tubular protection part being accommodated inside the separated spaces when the holder is mounted on the frame.

7. The connector of claim 5, wherein said operation member is supported pivotally on a rotating shaft disposed in a direction intersecting a direction in which said first and second housings are fit together;

configurations of the outer wall and openings of each of said concave accommodation portions being approximately rectangular when viewed in a direction in which the first and second housings are fit together; and the separated spaces being disposed along sides intersecting with the rotating shaft of the operation member.

8. The connector of claim 5, wherein the frame has a plurality of tubular accommodation parts in which said concave accommodation portions are formed independently of each other; and a part of each of said tubular accommodation parts (defining the inner wall separated from the outer wall.

* * * * *